United States Patent [19]

Wrenn

[11] 4,073,447

[45] Feb. 14, 1978

[54] ROLL FORMING, MEASURING AND CUTTING APPARATUS

[76] Inventor: Francis P. Wrenn, 128 St. Andrews Court, Mount Laurel, N.J. 08054

[21] Appl. No.: 748,692

[22] Filed: Dec. 8, 1976

[51] Int. Cl.[2] ..... B65H 19/26; B65H 17/06

[52] U.S. Cl. ..... 242/56 R; 242/55.3; 242/68.4; 242/74.1

[58] Field of Search ..... 242/56 R, 55.3, 68.4, 242/68.1, 68.2, 74.1, 74.2, 129.51, 129.52, 28.3, 79

[56] References Cited

U.S. PATENT DOCUMENTS

| | | | |
|---|---|---|---|
| 417,133 | 12/1889 | Barrett | 242/68.4 |
| 614,196 | 11/1898 | Willits | 242/55.3 |
| 991,827 | 5/1911 | Capers | 242/55.3 |
| 1,040,054 | 10/1912 | Therien et al. | 242/74.1 |
| 1,144,230 | 6/1915 | Newman | 242/55.3 |
| 1,242,149 | 10/1917 | Crane | 242/55.3 |
| 1,299,677 | 4/1919 | Carroll | 242/55.3 |
| 2,551,190 | 5/1951 | Walker | 242/55.3 |
| 2,590,384 | 3/1952 | Dent et al. | 242/55.3 |
| 2,771,251 | 11/1956 | Silverstein | 242/68.4 |
| 3,585,779 | 6/1971 | Thayer | 242/56 R |

*Primary Examiner*—George F. Mautz
*Attorney, Agent, or Firm*—Stanley B. Kita

[57] ABSTRACT

Apparatus for rolling, measuring and cutting material drawn from a selected one of a series of elongated rolls rotatably mounted horizontally in a rack. The apparatus comprises a frame having an elongated base member, a pair of arms extending forewardly therefrom, means releasably mounting the frame to the display rack, and means for forming a roll between the arms. The roll forming means includes a pair of mandrels rotatably mounted in spaced confronting relation between the arms, means to rotate the mandrels in unison about a common axis, and gripping means on each mandrel for releasably gripping marginal portions of the material. An upwardly-concave roll forming trough assembly is carried by the frame intermediate the mandrels for curling and supporting material rolled by the mandrels. The mandrels are mounted for movement axially relative to one another to enable the roll formed therebetween to be lifted from the roll forming trough assemblies. Means carried by the frame functions to measure the amount of material rolled, and a cutting assembly is provided to sever the material along the base of the frame.

20 Claims, 12 Drawing Figures

ROLL FORMING, MEASURING AND CUTTING APPARATUS

The present invention relates to roll forming apparatus, and more particularly, the present invention relates to portable apparatus for use in conjunction with racks for floor covering materials to enable measured quantities of the material to be rolled, measured, and cut to length.

At present, rolls of floor covering material, such as linoleum, carpet backing material, carpeting, etc. are stored in upright racks in warehouses, showrooms, etc. The rolls are mounted on axles supported at opposite ends in yokes mounted at vertically-spaced locations to uprights in the rack. To fill a customer's order, a quantity of the floor covering material is pulled from a roll, laid on the floor in front of the rack, measured and cut to length. Thereafter, the material is formed into a roll which is delivered to the customer.

This procedure has a number of disadvantages. First of all, a considerble amount of space must be provided in front of the rack in order to enable the material to be laid out and measured. Thus, aisles between racks must be relatively wide resulting in the disadvantage of increasing the space and cost required to store floor covering. Accordingly, apparatus which assists in enabling floor covering materials to be stored and dispensed in a minimum of space is highly desirable.

In addition to the storage problem, a considerable amount of labor is required in measuring, cutting and rolling floor covering in the above-noted manner. Also, care must be taken to avoid creases in the floor covering and to prevent the floor covering from becoming soiled when laid on the floor. Hence, it should be apparent that apparatus which enables floor covering to be rolled, measured and cut with a minimum of labor is commercially in demand.

Various types of roll forming devices are known. Examples of such devices may be found in the following U.s. Pat. Nos. 3,830,441; 3,524,373; 3,643,885; 2,706,094; 2,174,411; 2,463,790; 2,569,589; 2,716:006; 3,132,820; and 3,917,183. Although each of these devices may function satisfactorialy for its intended purpose, none is particularly suited for the purpose for which the present invention is intended to be used.

With the foregoing in mind, an object of the present invention is to provide novel apparatus for use in combination with a rack to enable a quantity of material stored in a roll in the rack to be removed, rolled, measured, and cut to length with a minimum of labor.

It is another object of the present invention to provide a unique device which is specifically designed to cooperate with a floor covering rack to enable a measured quantity of floor covering stored in rolls therein to be removed and rolledup while requiring only a minimum of floor space in front of the rack.

A further object of the present invention is to provide portable apparatus which is capable of being readily mounted and dismounted at different locations on floor covering racks to enable floor covering from any one of a number of rolls therein to be removed, rolled, measured, and cut in an efficient manner.

As a more specific object, the present invention provides apparatus for use in combination with a rack containing a series of rolls of material to enable material from a selected one of the rolls to be removed, measured, rolled and cut. To this end, the apparatus comprises a frame having a base member, a pair of arms extending outwardly from opposite ends of the base member, means for releasably fastening the base member to the rack adjacent a selected roll, and means located between the arms for forming a roll therebetween. The roll forming means includes a pair of mandrels rotatbly mounted between the arms, means in each mandrel for releasably gripping a marginal portion of material drawn from one roll, and means to rotate both mandrels in unison with one another. A roll forming trough assembly is mounted to the frame intermediate the mandrels to cause the material to curl into a roll during rotation of the mandrels and to support the rolled material. The mandrels are mounted for movement axially away from one another to enable them to be disengaged from the roll, and the trough assembly is designed to enable the roll to be lifted readily therefrom. Means is provided on the frame to measure the length of the rolled material, and a cutting assembly is mounted to the frame for movement along the base member to cut the material widthwise.

These and other objects, features and advantages of the present invention should become apparent from the following description when taken in conjunction with the accompanying drawings in which.

Figure 2:
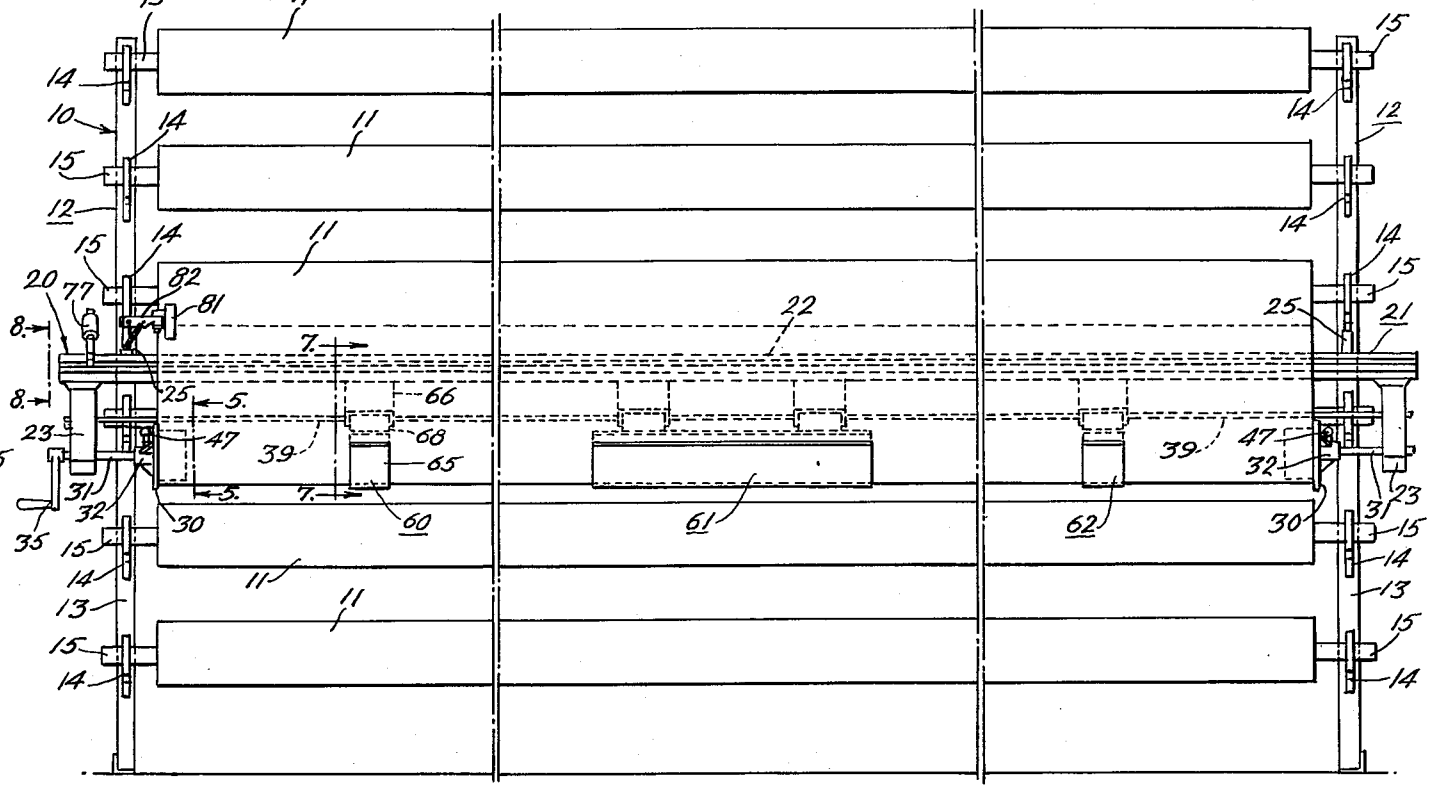
FIG. 2 is a longitudinally-foreshortened front elevational view of the rack and apparatus illustrated in FIG. 1.
Figure 1:
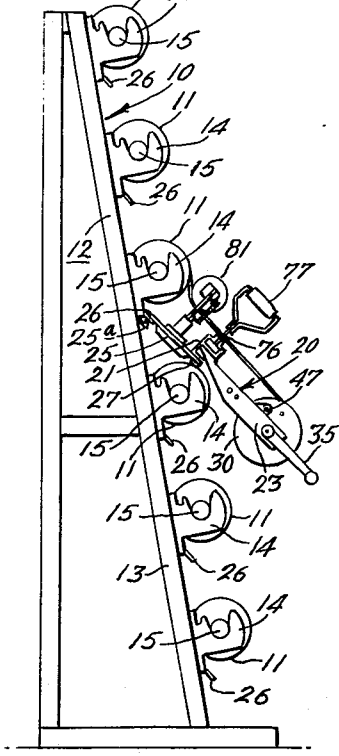
FIG. 1 is a view in end elevation illustrating apparatus embodying the present invention in combination with a rack mounting a series of rolls of floor covering.

Referring now to the drawings, FIGS. 1 and 2 illustrate a rack or stand 10 which is specially-designed to store a series of rolls of material 11,11 such as floor covering, carpeting, etc. The rack 10 includes a pair of upstanding column assemblies 12,12 each having an upwardly and rearwardly inclined strut 13. Each strut 13 mounts a series of yokes 14,14 adapted to rotatably receive an axle 15 about which each roll of material 11 is rolled. Thus, the rolls 11,11 are supported for rotation about horizontal axes in vertically-spaced relation in the rack 10.

Heretofore, several separate manual steps and a significant amount of labor has been required for workmen to remove material from a roll 11, to measure the material, to cut the material, and to form it into a roll, and this procedure has required a considerable amount of space in front of the rack 10. According to the present invention, apparatus 20 is provided for use in combination with the rack 10 to enable a measured quantity of material from one of the rolls 11 to be removed, rolled measured and cut in expeditious manner. To this end, the apparatus 20 comprises a frame 21 which includes an elongated base member 22 and a pair of hollow arms 23,23 extending outwardly from opposite ends of the base member 22. As best seen in FIG. 2, the spacing between the arms 23,23 is greater than the width of the rolled material, and the base member 22 extends beyond the column assemblies 12,12 in the rack 10. As best seen in FIG. 1, each arm 23 is relatively short, so that the entire apparatus 20 is relatively compact and does not protrude significantly in front of the rack 10.

In order to enable the apparatus 20 to be used to remove material from any one of the rolls 11,11 in the rack 10, means is provided to releasably mount the frame 21 to the rack 10 at selected vertical locations, and of course, to enable the apparatus 20 to be used with other racks of like construction. In the illustrated embodiment, the releasable mounting means includes a pair of hangers 25,25, preferably fabricated of angle iron, extending in spaced parallel relation from the underside of the base member 22 adjacent its ends. A clip 26 having a rectangular aperture therein is mounted to each yoke 14, and the upper end of each hanger 25 is provided with a suitably-shaped termination, such as the S-shaped hook **25*a* illustrated in FIG. 3. The hook 25*a* is received in the aperture in the clip 26 while the terminus 25' of the hanger 25 engages the bight at the juncture of the yoke 14 and the column assembly strut 13 to mount the frame 21 in somewhat of a cantilever fashion to the rack 10. To provide additional support, the bottom of the base member 22 mounts a pad of resilient material 27, such as Teflon, so that the base member 22 may rest on the adjacent lower roll without causing damage thereto. See FIGS. 1 and 3. Thus, the frame 21 may be readily dismounted and repositioned at any one of several selected vertical locations on the rack 10 to enable material to be drawn from any one of the rolls 11,11**.

For the purpose of forming the material 11 into a roll, a pair of mandrels 30,30 are mounted in spaced confronting relation between the arms 23,23 adjacent the outer ends thereof. In the present instance, the mandrels 30,30 are mounted for rotation about a common axis by means of stub shafts 31,31 which are journalled in the arms 23,23 by suitable bearings. Each mandrel 30 has a hub 32 which mates with spline means on the stub shaft 31 to enable the mandrel 30 to slide axially on the shaft 31 while being rotatably coupled therewith. In the illustrated embodiment, the spline means is provided by an elongated key 33 welded in a keyway in the stub shaft 31. Inward sliding movement of the mandrel 30 on its stub shaft 31 is limited by stop means which, in the present invention, is provided by a split ring 34 mounted in an annular groove in the outer end of the stub shaft 31. This structure enables the mandrels 30,30 to be placed in the positions illustrated in FIG. 2 during rolling of the material 11 while enabling the mandrels 30,30 to be slid apart axially in order to remove the roll formed thereon.

The mandrels 30,30 rotate in unison with one another during rolling of material. In the present invention, the mandrels 30,30 are rotated manually by means of a crank 35 which is capable of being removably mounted on the outer end **31*a* of each mandrel stub shaft 31. Mechanical means couples the mandrels 30,30 so that rotation of either mandrel shaft causes both mandrels 30,30 to rotate. In the illustrated embodiment, the mechanical coupling means includes a rotary drive member 36 mounted on the mandrel shaft 31 inside the arm 23 and a rotary idler member 37 mounted inside the arm 23 adjacent the base member 22. Preferably, the drive member 36 and idler or driven member 37 are sprockets, and they are interconnected by a chain 38 trained therearound. The idler members 37,37 are mechanically connected by an elongated cylindrical shaft 39 which extends parallel to the base member 22 and which is journalled in the arms 23,23 by suitable bearings. Thus, rotation of the crank 35 at the lefthand end of the apparatus 20 rotates the mandrel shaft 31 of the lefthand mandrel 30, and by virtue of the above-noted mechanical coupling, the righthand mandrel 30 rotates in synchronism with the lefthand mandrel 30**.

In order to enable the mandrels 30,30 to be engaged readily with the material 11 to be rolled and to be disengaged readily from the material rolled thereon, each mandrel 30 is provided with means for releasably gripping a marginal portion of the material 11. For this purpose, each mandrel 30 has a cylindrical peripheral wall 40 and a circular flange 41 extending radially outward from its hub 32 beyond the peripheral wall 40. A clamping surface 42 is provided on the inside of the peripheral wall 40 which has a slot 43 to enable a marginal portion **11*a* of the material 11 to be placed against the clamping surface 42 inside the mandrel 30. A clamping member 44 having an eccentric peripheral surface is mounted for rotation inside the mandrel 30 by a cooperating shaft 45 and a bolt 46. The clamping member 44 is pivoted by a handle 47 which is fastened to the clamping member shaft 45 by a bolt 48. Pivotal movement of the handle 47 clockwise from the broken line to the full-line position illustrated in FIG. 5 causes the eccentric surface of the clamping member 44 to rotate into proximity with the clamping surface 42 for clamping the marginal portion 11*a* of the material 11 therebetween. Pivotal movement of the handle 47 in the opposite direction, of course, unclamps the material 11 to afford disengagement of the roll from the mandrel 30**

Figure 5:
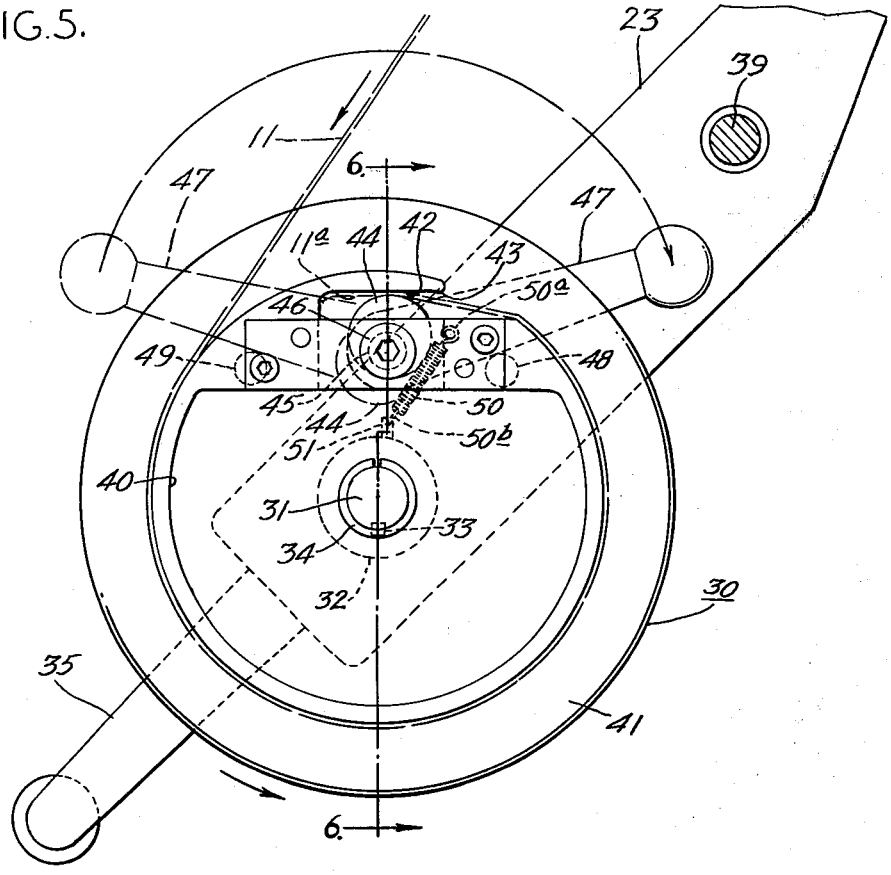
FIG. 5 is an enlarged sectional view taken on line 5—5 of FIG. 1 to illustrate a mandrel and means provided therein for releasably gripping material.
Figure 6:
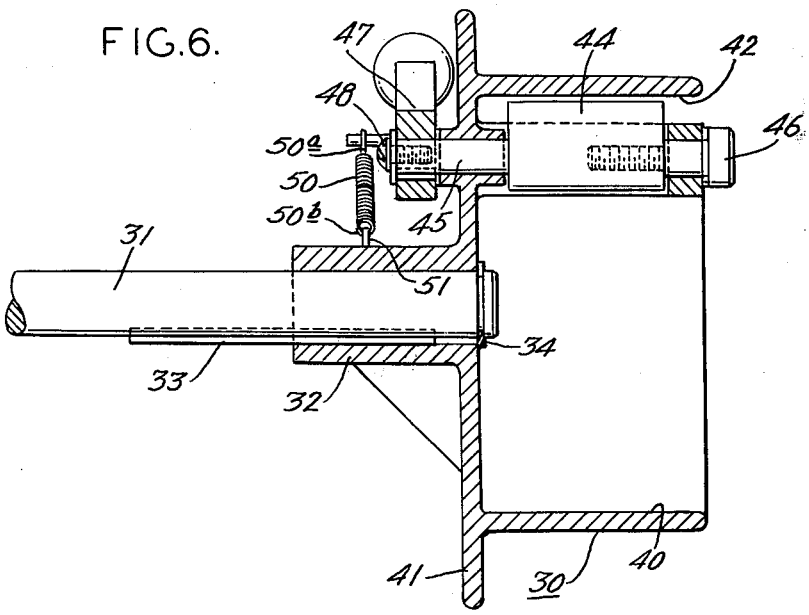
FIG. 6 is a sectional view of the mandrel and gripping means taken on line 6—6 of FIG. 5.

In order to maintain the clamping member 44 in clamping engagement with the material **11*a*, means is provided for releasably retaining the handle 47 in its locked position. As best seen in FIG. 5, this action is effected by an extensible elastic member 50 connected to the handle 47 and mandrel 30 for over-center motion relative to the pivot axis of the clamping member 44. In the present instance the extensible member is an extension spring 50 having an upper end 50*a* connected to the handle 47 adjacent the shaft 45 and having a lower end 50*b* connected to an eye 51 provided on the hub 32 of the mandrel 30. With this structure, pivotal movement of the handle 47 in the counterclockwise direction from the broken line position illustrated in FIG. 5 to the full-line position illustrated therein causes the spring 50 to extend as it passes over center. After the line of action of the spring 50 passes rightward of the rotational axis of the clamping member 44, the spring 50 pulls the handle 47 downwardly until the handle engages the stop pin 48**. This causes the surface of the clamping member 44 firmly to engage the marginal portion 11*a* of the material 11 engaged against the clamping surface 42 in the mandrel 30. The handle 47 is maintained in an unclamped position by a similar over-center action when the handle 47 is pivoted in the opposite direction to engage the stop pin 49.

Figure 4:
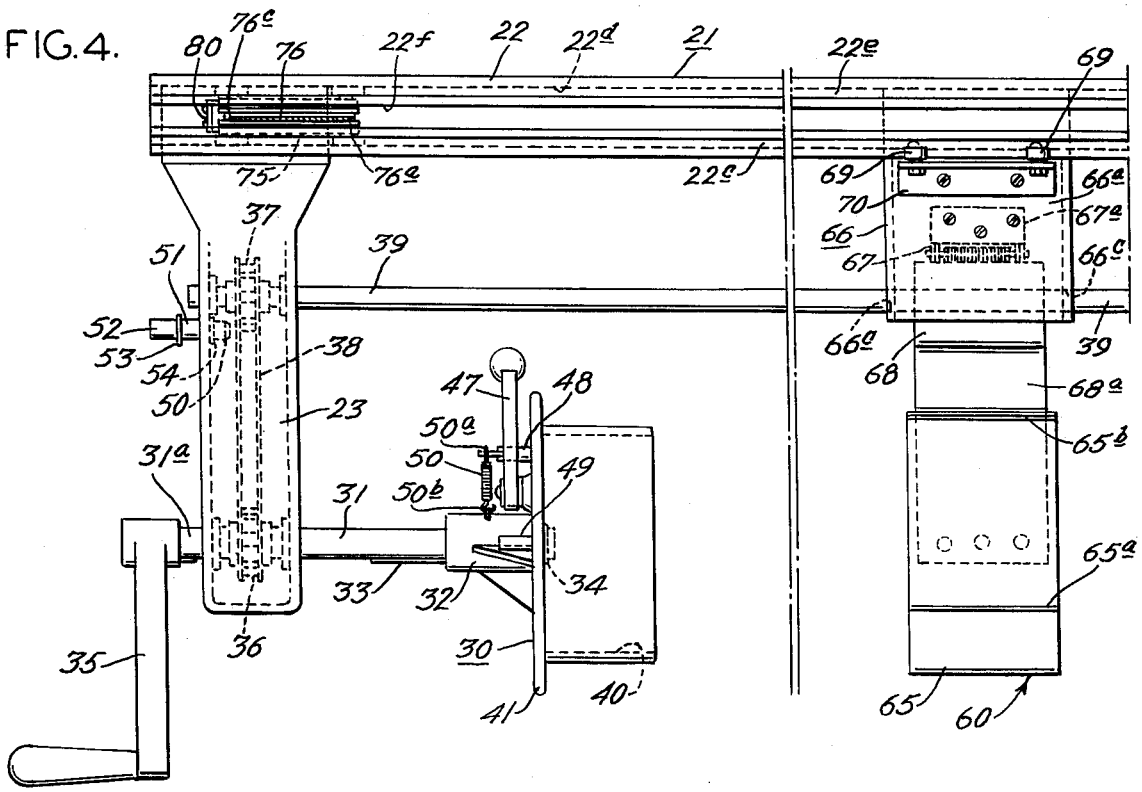
FIG. 4 is a foreshortened, fragmentary, sectional view taken on line 4—4 of FIG. 3.

In order to maintain the mandrels 30,30 stationary during clamping and unclamping of the material 11, means is provided on each arm 23, such as the lefthand arm illustrated in FIG. 4, to releasably retain the mandrels 30,30 against rotation. In the present instance, the releasable locking means includes a dog 50 adapted to engage between an adjacent pair of teeth in the idler sprocket 37 to prevent the sprocket 37 from rotating. The dog 50 is provided at the end of a pin 51 which is slidably mounted in the lefthand downturned wall of the arm 23. A knob 52 is provided on the outer end of the pin 51, and split-ring stops 53 and 54 are provided to limit the movement of the pin 51 relative to the arm 23. By virtue of this structure, the mandrels 30,30 can be rotated by the crank 35 until their slots 43,43 are positioned conveniently for receiving the material 11. Then, the knob 51 is pushed rightward to cause the dog 50 to engage the sprocket 37 for locking the mandrels 30,30 in position. Thereafter, the dog 50 is disengaged from the sprocket 37 to enable a workman to turn the crank 35 for rolling material on the mandrels 30,30.

The material 11 clamped by the mandrels 30,30 is automatically formed into a roll and supported during rotation of the mandrels 30,30. To this end, roll forming and supporting assemblies 60, 61 and 62 are carried by the frame 21 between its arms 23,23. In the illustrated embodiment, the roll forming and supporting assemblies 60 and 62 are identical in construction, and the assembly 61 is identical to the assemblies 60 and 62 except for the fact that it is substantially longer than the others and is normally positioned substantially centrally between the arms 23,23 of the frame 21 while the assemblies 60 and 62 are normally located closer to the arms 23,23. Since the roll forming assemblies 60–62 are of like construction, reference hereinafter will be made to the construction of the roll forming assembly 60 located at the left in FIG. 2.

Figure 7:
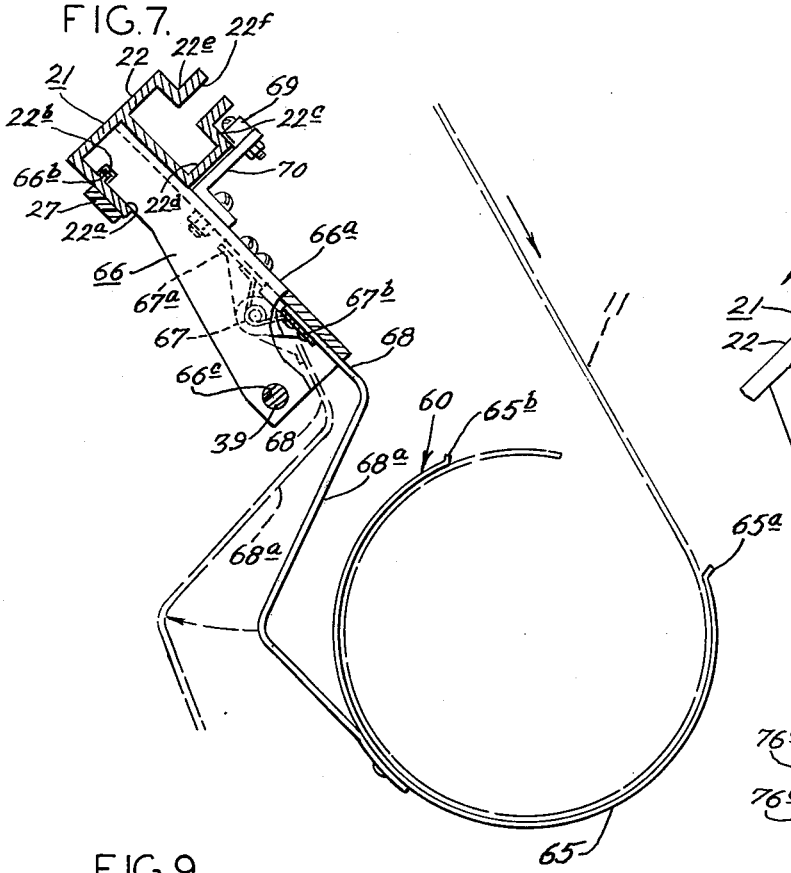
FIG. 7 is an enlarged sectional view taken on line 7—7 of FIG. 2.

Referring now to FIG. 7, the roll forming assembly 60 comprises a flexible concave trough 65 having a substantially C-shaped normally-empty transverse cross-section with spaced lips 65*a* and 65*b* forming a relatively wide entrance for receiving the material 11 when advanced forwardly (in the direction indicated by the arrow in FIG. 7) during rotation of the mandrels 30,30. The trough is canted rearwardly toward the base member 22 of the frame 21, and with respect to the path of movement of the material 11, its outer lip 65*a* is located at a level above the inner lip 65*b*. Preferably, the trough 65 is formed of a metal having spring-like qualities such as hard aluminum or spring steel to enable the trough 65 to expand and open laterally as the roll forms inside. The springiness of the trough 65 and the gap between the lips 65*a* and 65*b* also permits the roll to be lifted readily out of the roll forming and supporting assemblies 60–62.

To provide additional compensation for the increase in roll diameter, each trough, such as the trough 65, is mounted by a carriage or bracket 66 to the base member 22. The bracket 66 has an inverted U-shaped transverse cross-section with a horizontal web 66*a*, the underside of which mounts one end 67*a* of a conventional spring-loaded hinge assembly 67. The other end 67*b* of the hinge assembly 67 is mounted to the free end of a downwardly-offset arm 68, the outer end of which is secured to the underside of the trough 65. The depending portion 68*a* of the arm 68 is spaced from the left upturned leg of the trough 65 a sufficient distance to accomodate its outward expansion due to the increase in the size of the diameter of the roll. The torsion spring in the hinge assembly 67 operates normally to bias the trough 65 into the full-line position illustrated in FIG. 7 while enabling the roll former 65 to pivot clockwise as the diameter of the roll increases, such as indicated by the broken line position of the mounting arm 68. Clockwise pivotal movement of the trough 65 is, of course, limited by the engagement of the mounting arm 68 with the drive shaft 39.

The roll forming and support assemblies 60–62 are mounted to the frame 21 to slide out of the way when not in use to expose as much of the rolls as possible to view. For this purpose, the bracket 66 is mounted to slide on the base member 22. In the illustrated embodiment, the base member 22 is extruded and has a groove 22*a* facing the roll former trough 65. The bracket 66 has a tongue portion which extends into the groove 22*a* and a notch 66*b* which engages a rail 22*b* extending lengthwise of the base member 22 in its groove 22*a* to maintain the bracket engaged laterally with the base member 22. A pair of rollers 68 and 69 are rotatably mounted at the upper end of an L-shaped clip 70 fastened to the topside of the bracket web 66*a*. The rollers 68 and 69 roll on a ledge or surface 22*c* extending on the base member 22 and prevent the bracket tongue from binding in that channel 22*a*. The lower or outer end of the bracket 66 has a pair of aligned holes 66*c* which provide journals for the drive shaft 39 to permit it to rotate relative to the bracket 66 while enabling the bracket 66 to be slid therealong. Thus, the bracket 66 is supported both by the base member 22 and the drive shaft 39.

The material 11 is cut widthwise after being formed into a roll in the roll forming and support assemblies 60–62. To this end, the present invention provides means for cutting the material along the base member 22. In the illustrated embodiment the cutting means comprises a knife blade 76 projecting through a slot 22*f* formed between confronting angulated webs 22*c* and 22*e* overlying a channel 22*d* in the base member 22. The knife-blade 76 is mounted along its lower margin in a wheeled carriage 75 moveble in the channel 22*d*. A handle 77 is pivotally mounted to the upper end of the blade 76 to enable the carriage 75 to be pulled in the channel 22*d* for cutting the material overlying the base member 22. With this structure, the knife 76 is guided in a path parallel to the rotational axis of the roll of material 11, thereby enabling a workman to cut the material quickly and squarely.

Figure 8:
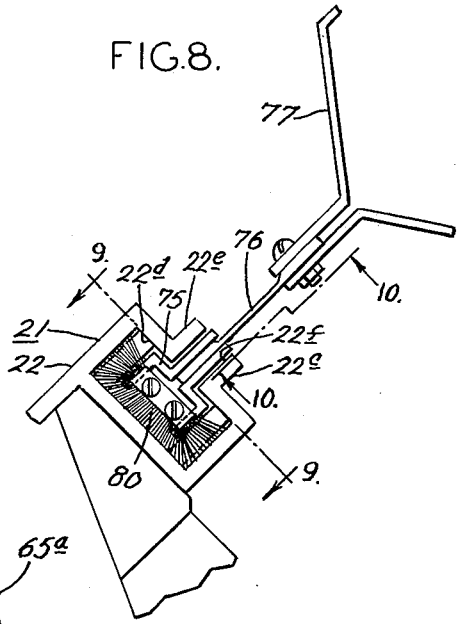
FIG. 8 is a greatly enlarged end elevational view taken on line 8—8 of FIG. 2.
Figure 10:
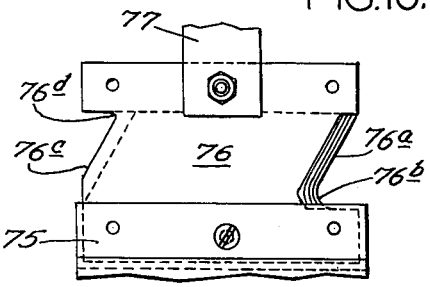
FIG. 10 is a fragmentary view taken on line 10—10 of FIG. 8 to illustrate a preferred blade employed in the apparatus of the present invention.
Figure 9:
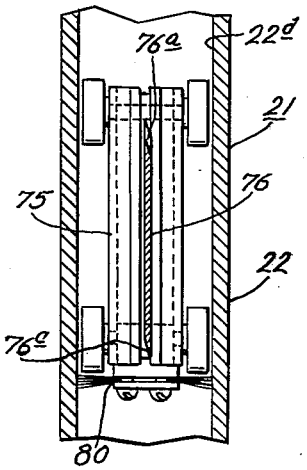
FIG. 9 is a fragmentary sectional view taken on line 9—9 of FIG. 8 to illustrate a portion of the cutting assembly used to sever the material.

According to the present invention, two different edge configurations are provided at opposite ends of the blade 76 for cutting different materials. For instance, the righthand or front edge 76*a* illustrated in FIG. 10 declines rearwardly from the top of the blade in the direction of movement of the blade to provide a bight 76*b* adjacent the bottom of the blade 76. This edge is used primarily for cutting relatively hard floor coverings such as linoleum, vinyl floor coverings, etc. The rear blade edge 76*c* illustrated to the left in FIG. 10 inclines parallel to the front edge 76*a* but forms a bight 76*d* adjacent the top of the blade. This edge is used to cut softer floor covering materials, such as carpeting, carpet backing, etc. To use one blade-edge or the other, the carriage 75 is simply pulled out one or the other ends of the channel 22*d*, turned around, and reinserted in the channel 22*d*. The channel 22*d* is kept clean to ensure smooth rolling of the carriage therein by means of a brush assembly 80 clamped to the rear end of the carriage 75 in the manner illustrated in FIGS. 8 and 9. Since opposite ends of the channel 22*d* are open, cuttings swept therein by the brush assembly 80 are discharged from the ends of the channel 22*d*.

Figure 3:
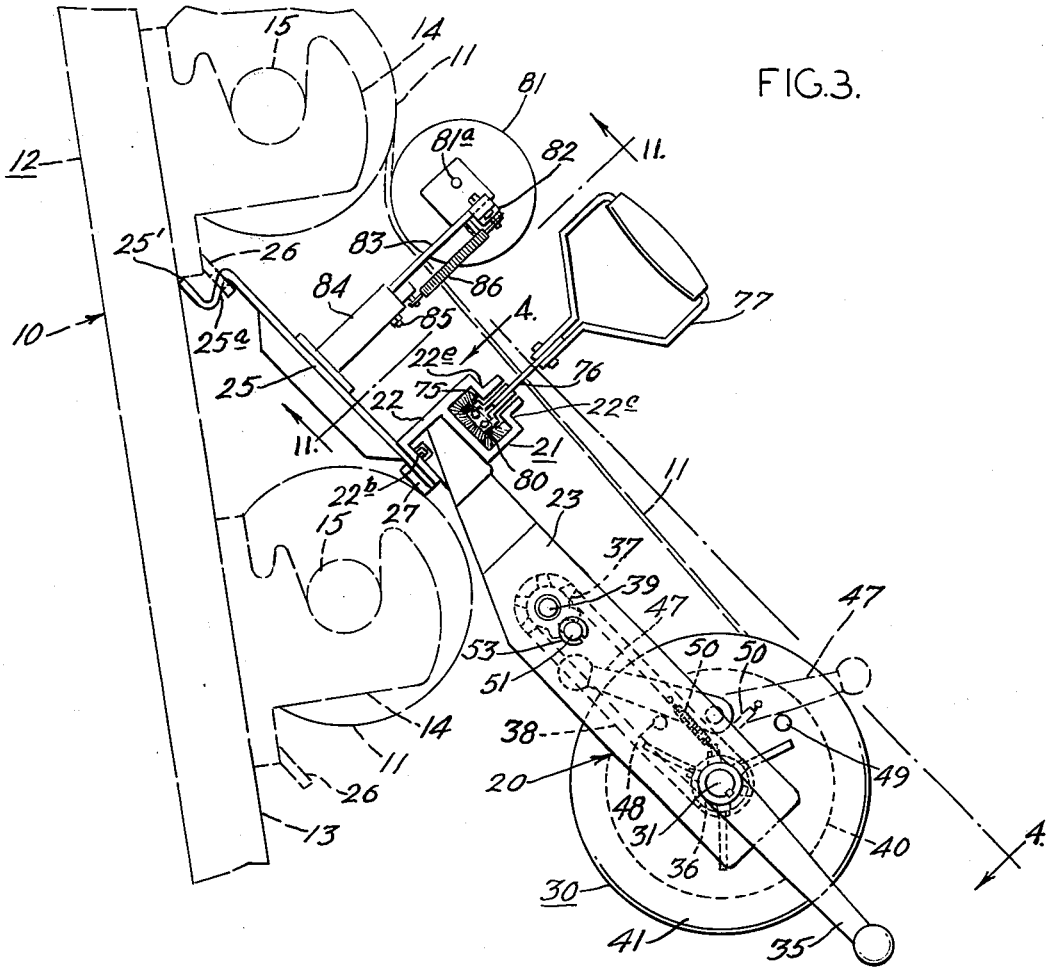
FIG. 3 is a greatly-enlarged, and elevational view illustrating the apparatus of the present invention in combination with a fragment of the display rack illustrated in FIG. 1.
Figure 11:
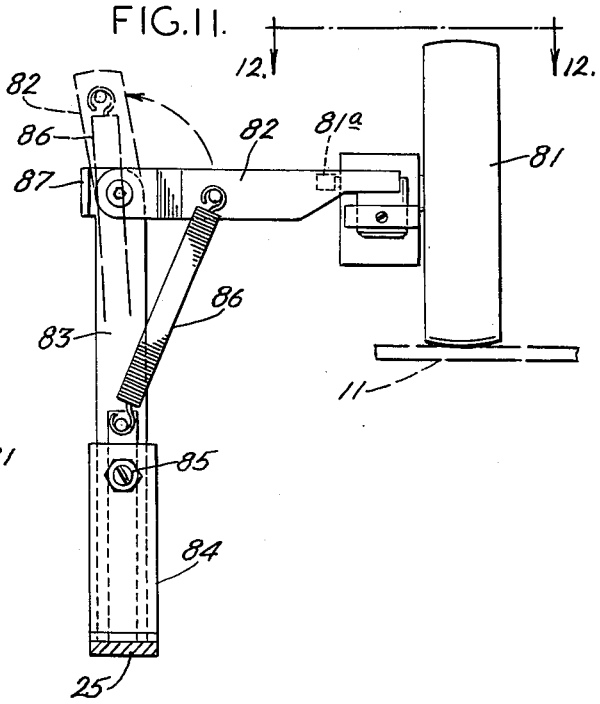
FIG. 11 is an enlarged sectional view taken on line 11—11 of FIG. 3 to illustrate means for measuring the material rolled by the apparatus of the present invention.
Figure 12:
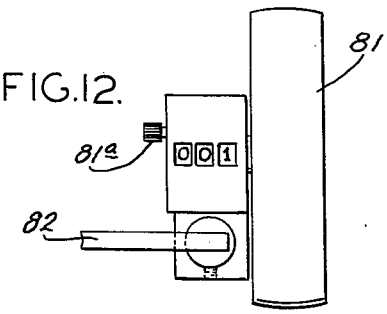
FIG. 12 is a fragmentary view taken on line 12—12 of FIG. 11.

For the purpose of accurately measuring the length of the material 11 formed into the roll before it is cut, means is provided on the frame 21 to measure the material 11 as it advances. As best seen in FIG. 3, the measuring means includes a wheel and odometer assembly 81 rotatably mounted at the outer end of an arm 82 which is mounted to pivot at its inner end to an upstanding stanchion 83 having a base 84 fastened to the topside of the left hanger 25. The stanchion 83 is mounted for limited vertical adjustment in its base 84 by a bolt 85 which is threaded in the base 84 and which engages the stanchion 83. An extension spring 86 connects the arm 82 to the stanchion 83 to maintain the roll 81 firmly engaged with the surface of the material 11. When not in use, the arm 82 is swung counterclockwise into engagement with a stop 87. This causes the spring 86 to pass over center with respect to the pivot axis of the arm 82 to maintain the arm in the position indicated partially in broken lines in FIG. 11 and thereby to maintain the wheel and odometer assembly 81 in its inactive position. The readout of the odometer associated with the wheel 81 is, of course, capable of being reset by the reset knot 81*a* each time a new measurement is to be taken.

In using the apparatus of the present invention, the frame 21 is mounted to the rack 10 below the roll from which mateial is to be taken. The mandrels 30,30 are slid axially inward toward one another, and the crank 35 is turned until the mandrel slots face toward the roll. The locking operator 52 is then pushed inwardly to engage the dog 50 with the sprocket 37 to lock the mandrels 30,30 in this position. A quantity of material 11 is then pulled from the roll and marginal portions 11*a*, 11*a* thereof are inserted in the slots 43,43 in the mandrels 30,30. Thereafter, the gripping levers 47,47 are pivoted rearwardly to clamp the material in the mandrels 30,30. The measuring wheel and odometer assembly 81 is pivoted clockwise into engagement with the upper surface of the material 11, and the locking operator 52 is released. The crank 35 is then rotated clockwise to cause the material 11 to curl on itself in the roll forming trough assemblies 60–62. After the desired quantity of material as indicated by the odometer readout has been formed into a roll, the workman grips the cutting assembly handle 77 with one hand, and with his other hand he pushes the material 11 downwardly toward the base member 22 as he advances the handle 77 and hence the knife blade 76 rightward across the width of the material 11. The roll in the roll forming and supporting asemblies 60–62 is then bound by cord or the like. The handles 47,47 on the mandrels are then pivoted forwardly to release from the material margins 11*a*, 11*a*, and the mandrels 30,30 are slid axially away from the ends of the roll. The roll may then be lifted upwardly out of the roll forming and supporting assemblies 60–62.

In view of the foregoing, it should be apparent that the present invention provides apparatus which functions to enable a measured quantity of flexible material, such as floor covering, to be rolled, measured, and cut with a minimum of effort and in a minimum of space. The apparatus of the present invention is portable, has few moving parts, and is relatively simple to operate. Because of its simplicity, the apparatus of the present invention does not require any training to operate, thereby enabling floor covering customers themselves to select, measure, and cut lengths of floor covering of their choice.

While a preferred embodiment of the present invention has been described in detail, various modifications, alterations, and changes may be made without departing from the spirit and scope of the present invention as defined in the appended claims.

I claim:

1. Apparatus for forming a roll of material from another roll of material mounted to rotate about a stationary axis in a roll rack, said apparatus comprising:

a frame having an elongated base member and a pair of arms extending outwardly from opposite ends of said base member;

a pair of mandrels mounted between said arms in spacec confronting relation;

means mounting said mandrels to said arms to rotate about a common axis;

means carried by said mandrels to releasably grip a marginal portion of the material;

means carried by said frame to afford axial movement of said mandrels toward and away from one another;

means for rotating both of said mandrels about their axes;

means carried by said frame for forming material into a roll and supporting the roll between the mandrels;

means carried by said frame for positioning said base member transversely to the path of movement of material onto said mandrels, said positioning means including a pair of hangers extending away from said base member in a direction opposite said arms, means carried by said hangers for releasably engaging said rack adjacent the ends of the roll supported therein, and means on said frame for cooperating with said rack and said hangers to releasably support said frame so that said arms extend outwardly of said rack; and a cutting assembly moveable along said base member for severing the material.

2. Apparatus according to claim 1 wherein said mandrel rotating means includes a rotary drive element carried by each arm and rotatable with each mandrel, a rotary idler element carried by each arm adjacent the base member, means mechanically coupling the drive and idler elements in each arm, and a drive shaft extending along said base member to connect said idler elements, whereby rotation of one mandrel causes the other mandrel to rotate in synchronism therewith.

3. Apparatus according to claim 1 including locking means carried by at least one of said arms for releasably retaining said mandrels against rotation in a preselected position.

4. Apparatus according to claim 1 wherein said means affording relative axial motion of each mandrel includes a stub shaft, and cooperating stop means on said stub shaft and said mandrel to limit movement of said mandrel outward of said arm.

5. Apparatus according to claim 1 wherein said releasable gripping means includes a clamping surface inside said mandrel, means providing a slot in the periphery of the mandrel to enable material to be placed against said clamping surface, a clamping member rotatable about an axis adjacent said clamping surface and having an eccentric peripheral surface moveable into and out of proximity with said clamping surface upon rotation in opposite directions about said axis, lever means connected to said clamping member for rotating the same about its axis, and retainer means for releasably retaining said clamping member in clamping relation with said clamping surface.

6. Apparatus according to claim 5 wherein said retaining means includes an extensible elastic element connected at one end to said lever and connected at its other end to said mandrel and operable upon rotation of the clamping member from an unclamped position to a clamped position to pass over center and thereby to retain the clamping member in a selected position.

7. Apparatus according to claim 1 wherein said roll forming and supporting means includes at least one assembly comprising a trough having a flexible wall with a substantially C-shaped normally-empty transverse cross-section, and means mounting said flexible trough to said frame in a manner affording flexure of said trough wall outwardly from its said normally-empty shape and movement of said trough wall downardly relative to said mandrel axis to accomodate the diametrical expansion of the roll formed therein during operation of the apparatus.

8. Apparatus according to claim 7 wherein said trough mounting means includes a bracket fastened to said base member, a mounting arm extending from said bracket, means fastening one end of said mounting arm to the underside of said trough so that said trough is canted toward said base member, and spring-biased hinge means mounting the other end of said arm to said bracket so that the center of the trough is disposed substantially coaxial with the mandrel axis when empty.

9. Apparatus according to claim 8 including means slidably mounting said bracket to said base member to enable the location of said trough to be adjusted between said arms.

10. Apparatus according to claim 9 wherein said base member has a groove opening toward said trough and said bracket has a tongue portion extending into said groove, rail means in said groove engaging a notch in said bracket tongue to maintain said tongue in said groove, and a roller assembly carried by said bracket for rotatably engaging said base member.

11. Apparatus according to claim 10 wherein said roll forming and supporting means includes a pair of auxiliary trough assemblies like in structure to said above mentioned roll former assembly and disposed on opposite sides thereof.

12. Apparatus according to claim 11 wherein said mandrel rotating means includes an elongated drive shaft extending between said arms alongside said base member, and means mounting said bracket to slide on said drive shaft to enable the location of the trough assemblies to be adjusted between the arms.

13. Apparatus according to claim 1 wherein said cutting assembly includes knife means, and means associated with said base member to guide said knife means parallel to said mandrel axis to sever material widthwise.

14. Apparatus according to claim 13 wherein said guide means includes a channel formed in said base member and having a slot, a carriage displaceable in said channel, a blade protruding upwardly from said carriage through said slot, and handle means connected to said blade for displacing said carriage in said channel and advancing said blade along said base member.

15. Apparatus according to claim 14 including brush means mounted to said carriage for sweeping the interior of the channel as the carriage advances therein.

16. Apparatus according to claim 14 wherein said blade has inclined front and rear edges disposed substantially parallel to one another, one of said edges having a bight adjacent the top of the blade and the other of said edges having a bight adjacent the bottom of the blade, whereby the knife means may be used to cut different kinds of materials.

17. Apparatus according to claim 1 including means for measuring material formed into a roll in said forming and supporting means, said measuring means including a wheel and odometer assembly engageable with the upper surface of the material, means mounting said wheel and odometer assembly to said frame for movement into and out of engagement with said material, and spring means biasing said wheel into contact with said material.

18. Apparatus for use with a storage rack including a pair of upstanding column assemblies each mounting a series of vertically-spaced pairs of yokes adapted to rotatably mount a series of rolls of material for rotation about horizontal axes so that a quantity of material can be removed from a selected one of said rolls, formed into another roll, and cut to length, said apparatus comprising:

a frame having a base and a pair of arms extending outwardly from said base, said arms being spaced apart a predetermined distance greater than the length of the roll in the rack;

means for mounting said frame to said rack so that said base extends parallel to the axis of said selected roll, said frame mounting means including a pair of hangers extending away from said frame and toward said column assemblies, releasable interengaging means on said hangers and said column assemblies to enable said frame to be mounted at various horizontal levels on said rack adjacent any of the rolls mounted therein, and support means for engaging said frame to support the frame in outwardly extending relation on the rack;

a pair of mandrels carried in spaced confronting relation by said arms;

means mounting said mandrels to rotate relative to said arms;

means carried by each mandrel for releasably gripping a portion of the material pulled from said one roll;

means for rotating said mandrels in unison about their axes to roll material simultaneously on both mandrels;

concave roll forming and supporting means carried by said frame between said mandrels for forming into a roll material rolled from said one roll in said rack and for supporting the formed roll between said mandrels;

means for moving said mandrels toward and away from one another to afford endwise disengagement of the mandrels from the roll formed in the roll former;

means carried by said frame for measuring material formed into the roll; and means movable along the base of the frame to sever the material after a measured quantity of material has been rolled.

19. Apparatus according to claim 18 wherein said releasable interengaging means includes a clip mounted adjacent each yoke, cooperating interengaging surfaces on said clips and hangers releasably fastening the hangers to the rack, and wherein said support means includes another one of the rolls in the rack located below said one roll and engaging said base member along a substantial portion of its length so that the arms extend outwardly in cantilever fashion from the rack.

20. Apparatus for forming a roll of material, comprising:

a frame having an elongated base member and a pair of arms extending outwardly from opposite ends of said base member;

a pair of mandrels mounted between said arms in spaced confronting relation;

means mounting said mandrels to said arms to rotate about a common axis;

means carried by said mandrels to releasably grip a marginal portion of the material;

means carried by said frame to afford axial movement of said mandrels toward and away from one another;

means for rotating both of said mandrels about their axes;

means carried by said frame for forming material into a roll and supporting the roll between the mandrels, said roll forming and supporting means including at least one assembly comprising a trough having a flexible wall with a substantially C-shaped normally-empty transverse cross-section, and means mounting said flexible trough to said frame in a manner affording flexure of said trough wall outwardly from its said normally-empty shape and movement of said trough wall downwardly relative to said mandrel axis to accommodate the diametrical expansion of the roll formed therein during operation of the apparatus, said trough mounting means includes a bracket fastened to said base member, a mounting arm extending from said bracket, means fastening one end of said mounting arm to the underside of said trough so that said trough is canted toward said base member, and spring-biased hinge means mounting the other end of said arm to said bracket so that the center of the trough is disposed substantially coaxial with the mandrel axis when empty, means carried by said frame for positioning said base member transversely to the path of movement of material onto said mandrels; and a cutting assembly moveable along said base member for severing the material.

* * * * *